US009631401B2

(12) United States Patent
Garthe et al.

(10) Patent No.: US 9,631,401 B2
(45) Date of Patent: Apr. 25, 2017

(54) PADLOCK

(71) Applicant: ABUS August Bremicker Sohne KG, Wetter-Volmarstein (DE)

(72) Inventors: Bernhard Garthe, Gevelsberg (DE); Wai Kuen Fan, Kowloon (HK)

(73) Assignee: ABUS August Bremicker Sohne KG, Wetter-Volmarstein ( * ) Notice: Subject to any disclaimer, the term of this patent is extended or adjusted under 35 U.S.C. 154(b) by 0 days.

(21) Appl. No.: 14/528,800

(22) Filed: Oct. 30, 2014

(65) Prior Publication Data

US 2015/0114050 A1 Apr. 30, 2015

(30) Foreign Application Priority Data

Oct. 31, 2013 (DE) ..... 10 2013 222 256

(51) Int. Cl.

| | |
|---|---|
| ***E05B 67/24*** | (2006.01) |
| ***E05B 67/06*** | (2006.01) |
| ***E05B 27/02*** | (2006.01) |
| ***E05B 9/04*** | (2006.01) |
| ***E05B 15/16*** | (2006.01) |
| *E05B 67/00* | (2006.01) |

(52) U.S. Cl.

CPC ..... *E05B 67/24* (2013.01); *E05B 9/04* (2013.01); *E05B 15/16* (2013.01); *E05B 27/02* (2013.01); *E05B 67/06* (2013.01); *E05B 67/00* (2013.01); *Y10T 70/437* (2015.04)

(58) Field of Classification Search

CPC ..... E05B 67/00; E05B 67/06; E05B 67/22; E05B 67/24; E05B 2067/06

USPC ..... 70/20, 31, 35, 38 R, 39, 40, 38 A, 38 B, 70/38 C

See application file for complete search history.

(56) References Cited

U.S. PATENT DOCUMENTS

| | | | | |
|---|---|---|---|---|
| 2,116,965 | A * | 5/1938 | Schoorel | E05B 67/24 70/361 |
| 3,172,279 | A * | 3/1965 | Patriquin | 70/38 A |
| 3,187,525 | A * | 6/1965 | Dies | E05B 67/24 70/368 |
| 3,613,409 | A * | 10/1971 | Paioletti | E05B 67/24 70/208 |
| 3,735,612 | A * | 5/1973 | Popovici | E05B 67/24 70/369 |
| 3,793,856 | A * | 2/1974 | Lippisch | 70/38 A |
| 3,879,721 | A * | 4/1975 | Yereance | E05B 45/02 116/67 R |
| 4,404,825 | A * | 9/1983 | Dixon et al. | 70/368 |

(Continued)

FOREIGN PATENT DOCUMENTS

| | | |
|---|---|---|
| AU | 2006230686 A1 | 5/2005 |
| CN | 202 139 932 U | 2/2012 |

(Continued)

*Primary Examiner* — Christopher Boswell

(74) *Attorney, Agent, or Firm* — Amster, Rothstein & Ebenstein LLP

(57) ABSTRACT

A padlock comprises a lock body, a hoop which is displaceably held at the lock body, a cylinder core into which at least one core pin is inserted and which is supported directly in a reception opening rotatable about a cylinder axis in order selectively to lock or release the hoop at the lock body, and a tumbler housing into which at least one housing pin is inserted and which is received in a fixed position in the lock body.

20 Claims, 3 Drawing Sheets

(56) References Cited

U.S. PATENT DOCUMENTS

| | | | | | |
|---|---|---|---|---|---|
| 4,998,422 | A * | 3/1991 | Borgmann et al. | 70/38 A | |
| 5,186,029 | A * | 2/1993 | Myers | E05B 67/24 70/371 | |
| 5,394,711 | A * | 3/1995 | Pitkanen | 70/38 A | |
| 5,896,761 | A * | 4/1999 | Chen | 70/38 A | |
| 6,425,274 | B1 * | 7/2002 | Laitala et al. | 70/394 | |
| 6,813,913 | B2 * | 11/2004 | Watts | 70/38 A | |
| 7,246,511 | B1 * | 7/2007 | Zhu | E05B 67/003 42/70.11 | |
| 8,245,547 | B1 * | 8/2012 | Garthe | E05B 67/24 70/367 | |

FOREIGN PATENT DOCUMENTS

| | | | |
|---|---|---|---|
| DE | 234360 | A | 5/1911 |
| DE | 7509538 | U | 7/1975 |
| DE | 9310547.9 | U1 | 11/1993 |
| DE | 19518042 | C1 | 6/1996 |
| DE | 102009023561 | A1 | 12/2010 |
| DE | 102011009591 | A1 | 8/2012 |
| EP | 0 605 932 | A2 | 7/1994 |

* cited by examiner

PADLOCK

The present invention relates to a padlock having a lock body and a hoop, the hoop being held displaceably at the lock body and being able selectively to be locked or released at the lock body.

The hoop of such a padlock is typically of U shape with two hoop limbs and can be displaced between a closed position in which both hoop limbs are introduced into the lock body and an open position in which one of the hoop limbs is still held in the lock body while the other exits the lock body.

To lock the hoop at the lock body in the closed position, that is to block it against a displacement into the open position, a locking device can be provided in the lock body which can be actuated by means of a lock cylinder and which can in this manner be secured against an unauthorized opening of the padlock. The padlock can then only be opened normally by means of a key associated with the lock cylinder.

The lock cylinder typically comprises a cylinder housing having a hollow cylindrical core reception section in which a cylinder core is supported rotatable about a cylinder axis and having an eccentric web section molded at the core reception section, with a plurality of pin tumblers being provided in the two sections. These pin tumblers each comprise a core pin at the cylinder core side and a housing pin at the cylinder housing side, which are aligned coaxially flush, and a pin spring which preloads the housing pin and the core pin in the direction of the cylinder core. Only when a suitable key has been inserted into a key receiver of the cylinder core, are the tumblers displaced axially against the preloading such that the respective separation surface between the core pin and the housing pin is arranged in the transition between the cylinder core and the cylinder hosing so that the cylinder core can be rotated in the cylinder housing to open the padlock. Otherwise the cylinder core is blocked against a rotation in the cylinder housing by the tumblers.

Such padlocks are known, for example, from the documents DE 10 2009 023 561 A1 and DE 10 20100 009 591 A1 and are comparatively expensive due to their high quality and security.

With such padlocks, the lock body can be colored or coated in another manner before the assembly with the other parts of the padlock (in particular before the insertion of the lock cylinder).

Colored padlocks, for example, serve for the marking and simple identification of different padlocks. In recent years, the significance of colored padlocks has moreover increased as a consequence of the spreading custom to fix padlocks to bridge railings or other special locations as so-called "love locks". In this respect, and also in other areas, the color serves for an individualization and an adornment of the appearance of a padlock.

A coating of the lock body can, however, not only serve for a visual improvement of the padlock, but also for a qualitative one in that it gives the padlock advantageous properties. A coating such as a zinc plating, a chromatization and/or a phosphatization of the lock body can thus serve as a corrosion protection, for instance. The hardness and/or the haptics of the surface of the lock body can furthermore be directly modified by a coating. The lock body can in particular be both colored and coated in a different manner, with the coloring and coating also being able to take place simultaneously by a single process, for example by means of anodizing by which a surface can be simultaneously colored and made more corrosion resistant. Provided that the lock body is coated by application of a corrosion protection, comparatively inexpensive materials can be used for the manufacture of the lock body which can also be machined easily in a cutting process.

To manufacture padlocks less expensively, provision can, however, also be made alternatively to the manner of construction with an inserted lock cylinder that a cylinder housing is dispensed with and that the functions of the cylinder housing, namely of rotatably supporting the cylinder core and of receiving the housing pins, are realized directly in the lock body. Such a padlock is disclosed in AU 2006230686 A1. Due to a lack of a cylinder housing, the pin passages designed as boreholes for the insertion of the housing pins are provided directly in the lock body itself in such a padlock, whereas the corresponding pin passages for the core pins are still provided in the cylinder core. In this respect, the pin passages are drilled into the lock body from the outside so that they are accessible to the pin tumblers from the outside. In the case of a lock body and of a cylinder core from a material which is easy to machine, such as brass, the pin passages can advantageously also be drilled from the outside through the lock body up to and into the cylinder core.

Brass moreover has the advantage that it has very good corrosion properties. Brass is, however, relatively expensive. If the comparatively high costs for brass are therefore to be avoided, alternative materials can also be used which allow boreholes over long distances like brass. However, the application of an additional corrosion protection is then required due to the higher corrosion proneness of such materials.

With the explained manner of construction without a cylinder housing, that is when the rotatable cylinder core is directly supported in the lock body, the named pin passages have to be reliably closed toward the outside after the insertion of the pin tumblers so that the security of the lock is not compromised. For this purpose, the pin passages can be closed by closure means, for instance by brass plugs (for example in padlocks having a lock body of brass or of another material) or by another material. It is necessary after the closing of the pin passages in such embodiments to secure the closure means against a release and ideally to make it unrecognizable in order not to provide any points of attack for manipulations at the padlock and in particular not to impair the corrosion resistance of the padlock. In this respect, the transitions between the closure means and the lock body are, for example, ground and/or post-machined (in particular post-coated) in another manner.

Such post-processing work in connection with colored padlocks and/or with padlocks coated in a different manner is, however, problematic since it is not possible or is only possible with an uneconomic effort to carry out the named post-machining work to be done for a secure and visually seamless closure of the pin passages such that a coloring and/or coating of the lock body carried out before the assembly of the padlock is not impaired. Such an impairment can, for example, result in that a surface coloring or a corrosion protection layer is locally removed due to a grinding or that a coloring appears visually different on the lock body and on the closure means, for instance when the lock body and the closure means comprise different materials. An inexpensive possibility of only carrying out a coloring or other coating of the lock body after the assembly of the padlock or of remedying a locally present impairment such as has been explained above in a visually unobtrusive manner is not known.

There is thus a problem in manufacturing a padlock of the named kind inexpensively, on the one hand, in that no complete lock cylinder (i.e. a separately operable lock cylinder) is required and in that a material can be used for the lock body which is sufficiently easy to machine, but is cheaper than brass, and, on the other hand, nevertheless to be able to provide the lock body with a uniform and resistant coloring and/or other coating (in particular with a corrosion protection layer) before the assembly of the padlock.

It is therefore an object to provide a padlock which can have a colored and/or coated lock body and which can be produced inexpensively in a simple manner.

The object is satisfied by a padlock having the features of claim 1 and in particular in that the padlock comprises a cylinder core into which at least one core pin is inserted and which is rotatably supported about a cylinder axis directly in a reception opening of the lock body in order selectively to lock or release the hoop at the lock body; and in that the padlock furthermore comprises a tumbler housing into which at least one housing pin is inserted and which is received in a fixed position in the lock body.

It is important in this respect, on the one hand, that the cylinder core is directly rotatably supported in a reception opening of the lock body. The padlock is consequently without a cylinder housing. A core reception section such as has been explained with respect to the prior art is not present. The support of the cylinder core takes place directly by the lock body. In this respect, an outer jacket surface of the cylinder core can, for instance, directly contact an inner jacket surface of the reception opening, with the jacket surface of the cylinder core in particular being slidingly guided at the jacket surface of the reception opening on a rotational movement of the cylinder core. The cylinder core in this respect preferably contacts the reception opening at least substantially over its total longitudinal extent in the direction of the cylinder axis. In this manner, the cylinder core can be reliably rotated about its cylinder axis relative to the lock body without a cylinder housing being provided.

On the other hand, a tumbler housing which is separate or independent of the lock body and which is arranged at a fixed position in the lock body, which is in particular solid, is provided for the function of receiving the at least one pin tumbler. The tumbler housing is therefore in particular arranged secure against losing and axially secured relative to the lock body. The function of receiving respective pin tumblers is therefore not, just like the support of the cylinder core, taken over by the lock body with the padlock in accordance with the invention. One or more pin tumbler passages, for instance in the form of pin tumbler boreholes, into which the housing pins are inserted are in particular provided in the tumbler housing. They can in addition receive the pin springs of a respective pin tumbler. The lock body is, in contrast, free of pin tumbler passages or pin tumbler boreholes. In this respect, as also in the total description, the term "borehole" is in each case to be understood respectively in a geometrical aspect and independently of the respective manufacturing process. A borehole in a body accordingly has a geometry such as can arise by drilling and can, however, also be formed, for instance, by molding the body or in another manner.

A respective housing pin inserted into the tumbler housing is in particular associated with a respective core pin inserted into the cylinder core and they together form a pin tumbler of the padlock together with a respective pin spring. So that the cooperation of the core pin and of the housing pin between the cylinder core and the tumbler housing can block or release a rotation of the cylinder core relative to the tumbler housing (or the lock body), provision is in particular made that the cylinder core and the tumbler housing are arranged adjacent to one another and/or contacting one another. In this respect, the tumbler housing does not, however, surround the cylinder core over its full periphery in the manner of a cylinder housing. A large part of the periphery of the cylinder core is rather directly adjacent to the lock body, whereas only a smaller part is directly adjacent to the tumbler housing.

A padlock whose closing mechanism comprises pin tumblers for blocking or releasing the cylinder core typically has a plurality of pin tumblers to allow a plurality of different codings for different keys. It is, however, also conceivable to provide a closing mechanism which only has a single pin tumbler, for example when the closing mechanism comprises further tumblers of this kind such as plate tumblers and/or disk tumblers and different kinds of tumbler can therefore be combined in one lock.

In comparison with a typical cylinder housing, the tumbler housing can be manufactured particularly simply and inexpensively. This is in particular due to the fact that the tumbler housing advantageously does not need to have any reception opening for a rotatable support of the cylinder core. The decoupling of the two functions which a cylinder housing typically carries out, namely the support of the cylinder core and the reception of respective pin tumblers and the division of these functions to the block body, on the one hand, and to a tumbler housing provided instead of a cylinder housing, on the other hand, thus allows a particularly economical production of the padlock, without the lock body in this respect being damaged by pin passages for respective pin tumblers.

Since the lock body does not have any pin passages drilled into the lock body for respective pin tumblers, closure plugs such as have been explained above with respect to the prior art are also not required for the padlock in accordance with the invention. This ensures that the lock body can already be colored and/or coated before the assembly of the padlock. A post-machining for securing, for protecting and/or for disguising originally present openings, closure plugs and/or transitions after the assembly is not necessary so that the coloring or coating remains unimpaired. The material for the lock body can furthermore be selected independently of whether it can be post-machined or can be easily connected to a specific closure means or of whether it has a particularly good corrosion resistance. The material of the lock body can rather be selected, for example, under the aspects of high security, good processability colorability, coating ability and/or of price.

In accordance with an embodiment, the tumbler housing is pressed in the lock body. The tumbler housing and the lock body can therefore be connected to one another with force transmission without separate connection means. For this purpose, the tumbler housing can be pressed into the lock body. The lock body can, for example, as will be explained below, have a reception opening for the tumbler housing into which the tumbler housing is inserted. In this respect, the tumbler housing and the reception opening can be configured in the manner of an interference fit with respect to one another to establish a force-transmitting connection between the tumbler housing and the lock body. It is also conceivable that at least parts of the surface of the tumbler housing interact with surfaces of the lock body by a force effect such as a blow and are in this manner pressed to the lock body or pressed in. It is common to all kinds of pressing (or combinations thereof) in this respect that they are particularly simple construction-wise and can therefore take place particularly inexpensively. In addition, the lock body is not attacked by such a pressing so that a coloring and/or coating of the lock body also remains unimpaired.

Alternatively or additionally to a pressing, the tumbler housing can, for example, also be received with force transmission at a fixed position in the lock body. For example, an axial fixing of the tumbler housing in the lock body can take place by means of a circlip which engages into an associated groove in the lock body, whereas a positional fixing of the tumbler housing in the direction of rotation can be achieved by a complementary shape of the tumbler housing, on the one hand, and of the cylinder core, on the other hand.

In a further embodiment, a securing pin is provided to hold the cylinder core axially fixedly in the lock body. In this respect, the securing pin serves to fix the cylinder core non-displaceably in an axial direction so that the cylinder core cannot slide or be pulled out of the lock body. In this respect, the cylinder core is only axially fixed by means of the securing pin, whereas the rotatability of the cylinder core about the cylinder axis is not blocked. However, the rotatability of the cylinder core can be restricted to an angular range in interaction with the securing pin, as will still be explained.

In accordance with a further development, the securing pin is inserted into a securing pin passage of the tumbler housing, in particular in a borehole, extending in parallel with the at least one housing pin. In this respect, the securing pin and respective housing pins of the padlock can extend aligned in parallel with one another from the tumbler housing in the direction of the cylinder core. One or more pin passages, which are similar to or identical with the securing pin passage, are in particular provided for a respective housing pin, in particular one or more boreholes. In this case, the pin passages for the securing pin and respective housing pins preferably have the same diameter so that they can e.g. be produced inexpensively using the same tool. The securing pin can correspondingly be shaped substantially similar to a housing pin and in particular have the same diameter. In contrast to a longitudinally displaceably pin tumbler, the securing pin can be inserted immovably in the pin passage at least with respect to its longitudinal extent.

When the securing pin is inserted in the tumbler housing, the axial holding of the cylinder core in the lock body consequently takes place indirectly in that the cylinder core is axially fixed relative to the tumbler housing via the securing pin, whereas the tumbler housing is received in a fixed position in the lock body.

It is furthermore advantageous if the securing pin is inserted in a throughgoing pin passage of the tumbler housing. Throughgoing pin passages can be produced particularly simply. Respective pin passages for a respective housing pin can also be formed as throughgoing pin passages in the tumbler housing. The securing pin and respective housing pins having respective pin springs can then be very simply inserted into the pin passages. Since the tumbler housing is received in the lock body, the end abutment which is missing with throughgoing pin passages can in particular be formed by the lock body itself.

In an advantageous embodiment, the securing pin is arranged behind the at least one housing pin the direction of insertion of the key. The axial fixing of the cylinder core in the lock body then takes place particularly deep in the cylinder core, that is particularly far away from the key insertion opening of a keyway formed in the cylinder core. An improved security of the fixing of the cylinder core in the padlock is thereby achieved since the securing pin cannot be reached from the outside.

The cylinder core is preferably only axially fixedly held in the lock body by the securing pin. In this manner, the cylinder core can be coupled to the tumbler housing via the securing pin and can be axially fixed in the lock body via the tumbler housing. Since the cylinder core is therefore not directly coupled to the lock body, the cylinder core and the tumbler housing can be inserted into the lock body together with respective pin tumblers arranged therebetween and the securing pin. The tumbler housing can then be fixedly connected to the lock body, for instance by the above-explained pressing, whereby the cylinder core is also axially fixedly held in the lock body. This simple and reliable assembly makes possible in an inexpensive manner a high flexibility, e.g. in the combination of different, e.g. differently colored, lock bodies with units of cylinder core and tumbler housing encoded for different keys.

In accordance with an embodiment, the securing pin engages into a groove of the cylinder core extending in the peripheral direction with respect to the cylinder axis. Due to this extent of the groove, the cylinder core and the tumbler housing can be coupled with one another by the engagement of the securing pin into the groove such that a rotational movement of the cylinder cover about its cylinder axis is made possible, but an axial movement of the cylinder core relative to the tumbler housing is not possible.

In this respect, the coupling of the cylinder core to the tumbler housing by means of the securing pin engaging into the named groove cannot only serve for the axial fixing of the cylinder core with a simultaneous rotational movability, but can also restrict this rotational movability directly by the length of the groove. In an advantageous embodiment, the rotatability of the cylinder core is thereby restricted to an angular range of less than 180°, in particular of less than 120°, preferably to approximately 110°, in that the groove only extends over a corresponding angular range of the periphery of the cylinder core. Such an angular range can be sufficient for the actuation of a locking device of the padlock by means of a key inserted into the aforesaid keyway of the cylinder core. The angular range can generally even be restricted more, for instance to approximately 45° or less, by the extent and the shape of the groove or by other elements.

The groove is preferably arranged behind the at least one core pin in the insertion direction of the key. The front and predominant part of the cylinder core in the insertion direction of the key can thus provide space for an axial keyway and for respective radial core pin passages, whereas space for the named groove remains in a region distal of the opening of the keyway, into which region a key projects at most with its tip.

In accordance with an advantageous embodiment, the reception opening is configured as a reception borehole for receiving the cylinder core, with the lock body having a further reception opening, in particular a further reception borehole, for receiving the tumbler housing. Such a respective reception borehole is in particular of cylindrical shape. In this respect, the respective reception opening is preferably matched to the shape of the cylinder core or of the tumbler housing such that the cylinder core and/or the tumbler housing is/are substantially completely received in the lock body and in particular terminate flush or approximately flush with an outer surface of the lock housing.

In accordance with a further development, the two reception boreholes are arranged next to one another and mutually overlapping. The two reception openings are in particular cylindrical and are aligned in parallel with one another. Such reception openings can be drilled in a simple manner into a solid lock body. If the reception openings have the same diameter, the same tool can advantageously be used for this purpose. In this respect, a border region is formed by the overlap of the two reception regions between the cylinder core and the tumbler housing in which the cylinder core and the tumbler housing can in particular interact with one another via respective pin tumblers and/or via the securing pin.

In a further embodiment, the tumbler housing is substantially cylindrical and is aligned in parallel with the cylinder core. In this respect, the tumbler housing can be formed in one part as can also the cylinder core. The cylinder core and the tumbler housing preferably have the same diameter. With a cylindrical tumbler housing, pin passages, in particular boreholes, for respective housing pins or for a securing pin, can intersect the cylinder axis of the tumbler housing perpendicular and can in particular be configured as throughgoing pin channels.

In accordance with an advantageous further development, the tumbler housing has a cut-out arcuate in cross-section which extends in the axial direction and which the cylinder core contacts. A shape-matched security against rotation of the tumbler housing can hereby be effected relative to the cylinder core. The cut-out can in this respect just correspond to the named overlap of the reception openings for the cylinder core or for the tumbler housing. Pin passages for respective housing pins or for a securing pin can then open into the concave surface of the tumbler housing formed by the cut-out. In this manner, respective pin tumblers or the securing pin can interact via this concave surface, which forms a boundary surface between the tumbler housing and the cylinder core, with associated pin passages, in particular boreholes, for respective core pins or with the groove in the cylinder core.

In a preferred embodiment, a locking device for the selective locking and release of the hoop is provided which comprises a rotational latch drive-effectively coupled to the cylinder core and two blocking balls which can be pressed by means of the rotary latch into a respective locking recess of the hoop limb of the hoop. This locking device together with the cylinder core driving it them forms a constructionally simple and reliable closing mechanism of the padlock.

The invention furthermore relates to a method of manufacturing a padlock such as is described above, wherein first the lock body of the padlock is coated, in particular colored, and then the padlock is assembled. The assembly of the padlock in particular comprises the tumbler housing being pressed in the lock body.

The invention will be explained in the following only by way of example with reference to the drawings.

Figure 1:
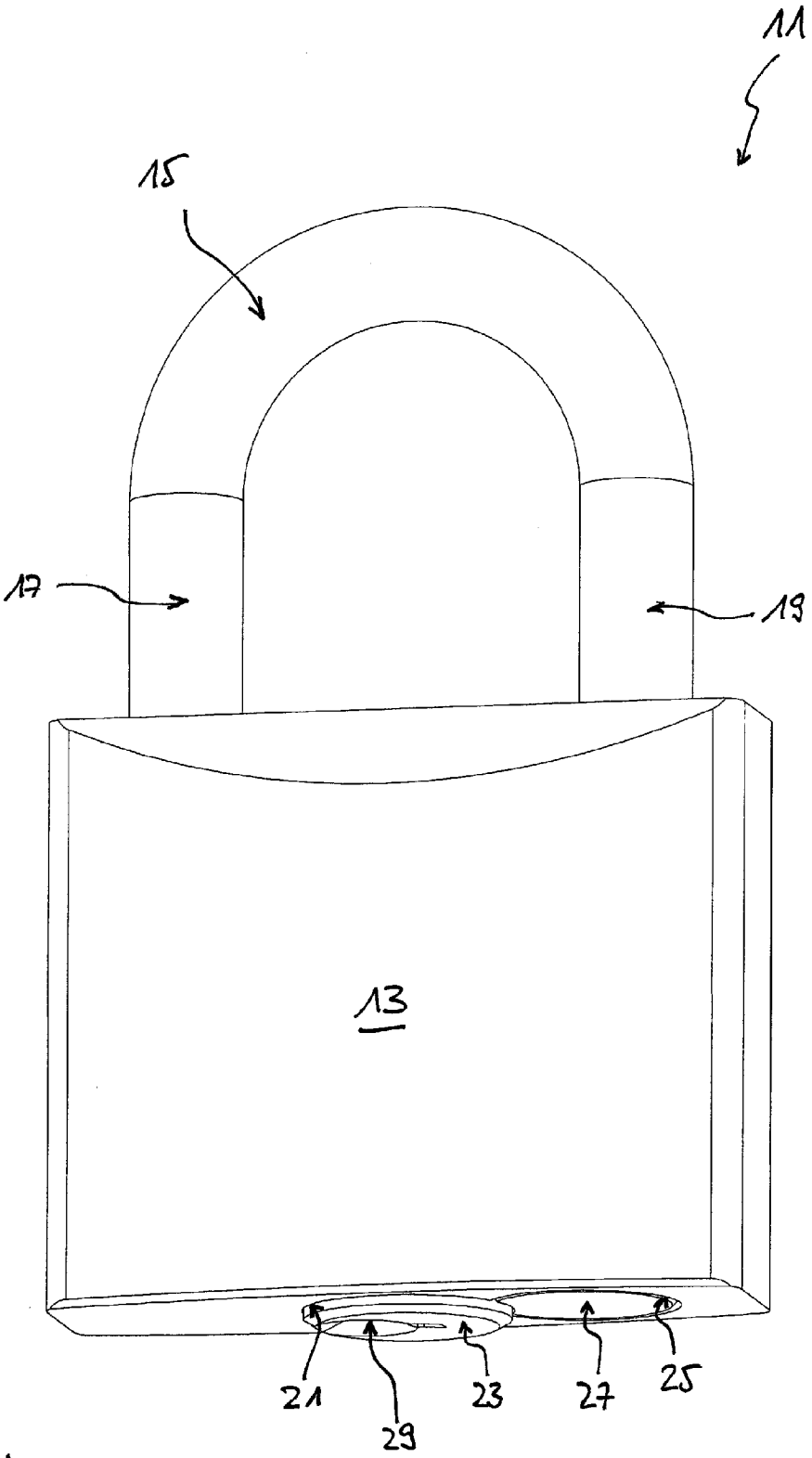
FIG. 1 shows an embodiment of a padlock in accordance with the invention in a schematic perspective view.

An exemplary embodiment of a padlock 11 in accordance with the invention is shown in FIG. 1. The padlock 11 comprises a solid lock body 13, for example of iron or of an iron alloy such as steel, which is coated (e.g. provided with corrosion protection) and/or colored at its outer surface. In this respect, the lock body 13 can in particular be formed by cutting an extruded material to length. It is, however, also conceivable that the lock body 13 is produced by molding. A hoop 15 having a long hoop limb 17 and a short hoop limb 19 (cf. FIGS. 2 and 3) is inserted into two hoop receivers (which cannot be recognized in the FIG.) of the lock body 13. The hoop 15 is held linearly displaceably in the hoop receivers so that the short hoop limb 19 can exit the associated hoop receiver in an open position of the padlock 11 and can thus open the padlock.

A reception opening in the form of a reception borehole 21 is formed at the side of the lock body 13 disposed opposite the hoop receivers and a similar further reception opening in the form of a further reception opening 25 is formed for a tumbler housing 27 inserted therein. The reception boreholes 21, 25 formed in circular form in cross-section are arranged next to one another and overlapping one another. The cylinder core 23 and the tumbler housing 27 substantially terminate flush with the lock body 13, with a peripheral chamfer in the cylinder core 23 leading to the outer end face of the cylinder core 23 projecting slightly out of the lock body 13. A key insertion opening 29, which forms an opening to a sectional keyway 31 extending in the cylinder core 23 (cf. FIG. 3) is located in this end face.

Figure 2:
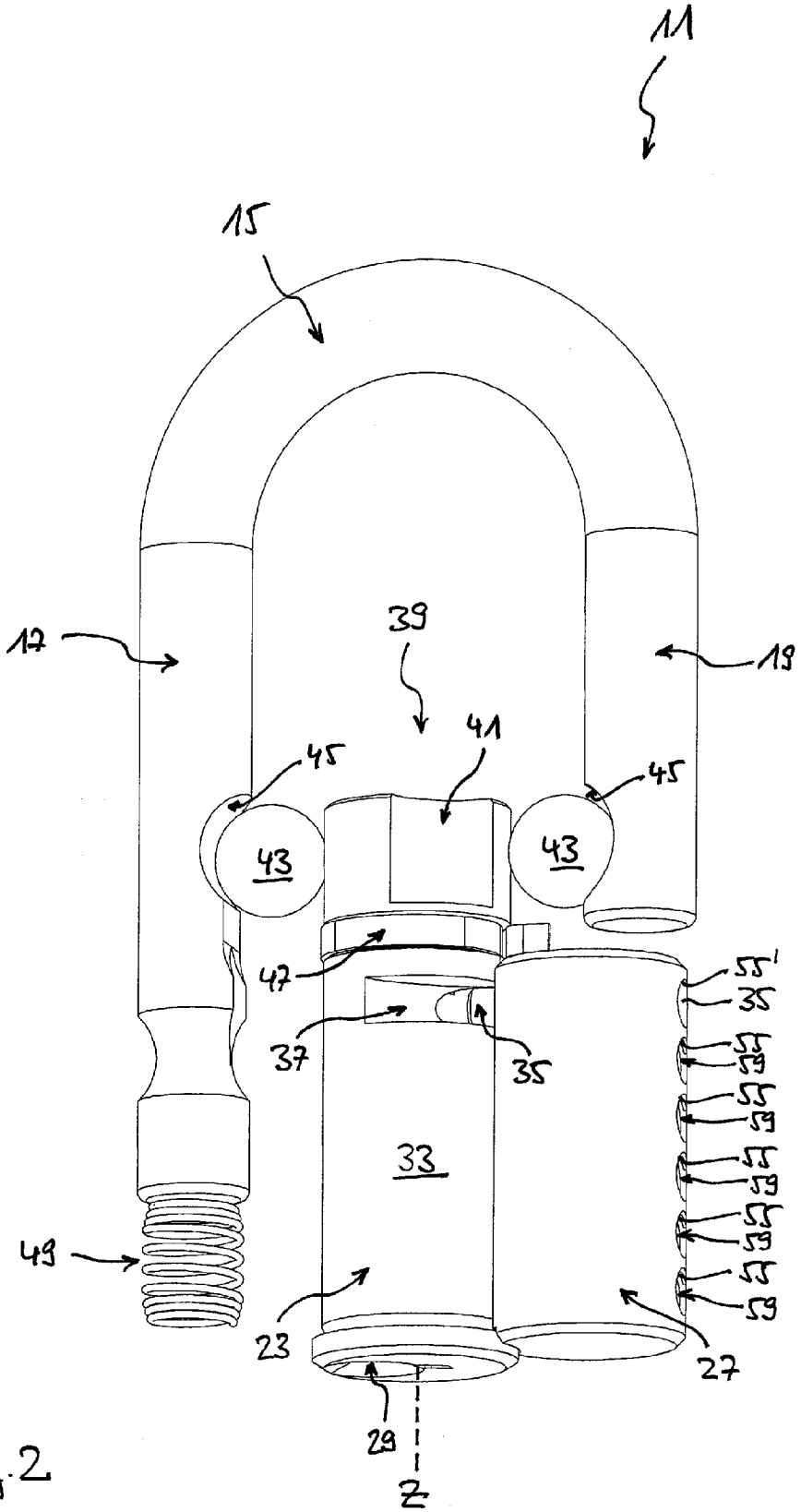
FIG. 2 shows the same embodiment without a lock body so that elements in the interior of the padlock can be seen.
Figure 3:
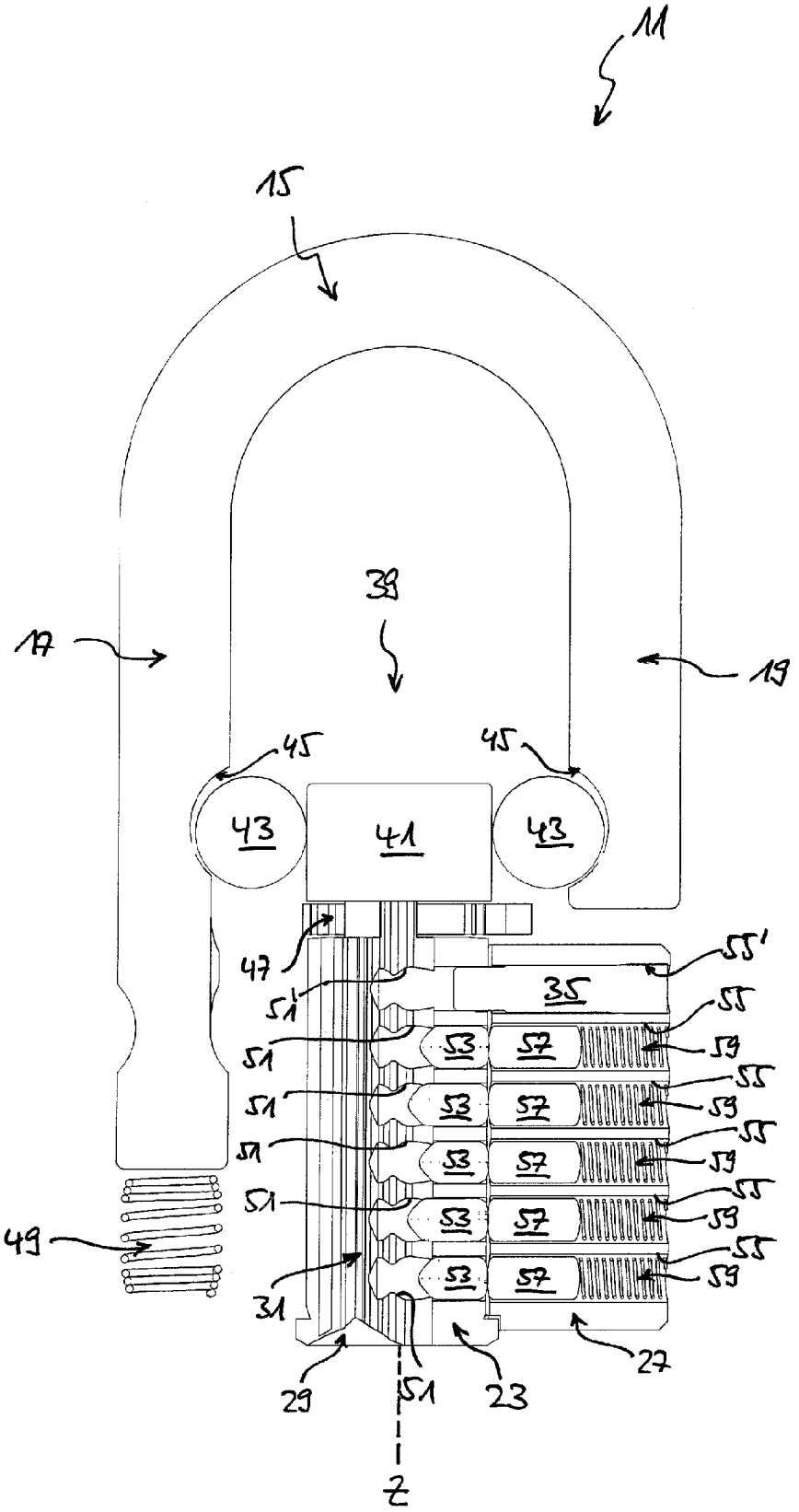
FIG. 3 shows the same embodiment in a perpendicular plan view of a cross-section.

As can be recognized in FIGS. 2 and 3, the cylinder core 23 is formed cylindrically in one part and is aligned in accordance with a cylinder axis Z. The tumbler housing 27 is equally also formed cylindrically in one part and has the same diameter as the cylinder core 23 to which it is aligned in parallel. In this respect, the tumbler housing 27 has a cut-out arcuate in cross-section which extends in an axial direction and which corresponds to the overlap of the reception boreholes 21, 25 circular in cross-section. The cylinder core 23 contacts the tumbler housing 27 at this overlap.

The remaining jacket surface 33 of the cylinder core 23 directly contacts the inner jacket surface of the reception borehole 21 in the lock body 13 and is slidingly guided from the jacket surface of the reception borehole 21 on a rotation of the cylinder core 23. In this manner, the cylinder core 23 is supported rotatable about the cylinder axis Z directly in the lock body 13.

The tumbler housing 27 is in contrast received in a fixed position in the further reception borehole 25 of the lock body 13 and is for this purpose fixed in a force-transmitting manner by pressing in the reception bore 25. A securing pin 35 extends perpendicular on the cylinder axis Z from the tumbler housing 27 into a groove 37 of the cylinder core 23, the groove extending in a region of the cylinder core 23 distal from the key insertion opening 29 in the peripheral direction. The cylinder core 23 is held axially non-displaceably relative to the tumbler housing 27 by the engagement of the securing pin 35 into the groove 37. Since the tumbler housing 27 is pressed in a fixed position in the lock body 13, the cylinder core 23 is thus also fixed in its axial position relative to the lock body 13. No other fixing of the cylinder core 23 in the lock body 13 takes place. The groove 37 extends over an angular range of approximately 110° along the periphery of the cylinder core 23 so that the interaction of the securing pin 35 and the groove 37 also has the effect that a rotational movement of the cylinder core 23 in the reception borehole 21 is restricted to at most this angular range.

A locking device 39 can furthermore be recognized in FIGS. 2 and 3 which comprises a rotational latch 41 drive-effectively coupled to the cylinder core 23 and two blocking balls 43. Depending on its rotational position, the rotational latch 41 presses the blocking balls 43 radially outwardly into respective locking recesses 45 of the hoop limbs 17, 19 of the hoop 15 or makes it possible that the blocking balls 53 can exit from the locking recesses 45. In this manner, the hoop 15 can be selectively (as shown) locked or released by means of the locking device 39 in its shown closed position.

The drive-effective coupling between the cylinder core 23 and the rotational latch 41 in this respect does not have to be rotationally rigid, but can rather have a defined clearance in order to allow an automatic function in a manner known per se such that the hoop 15 can also be moved in a latching manner from the open position into the closed position in the position of the cylinder core 23 shown in the Figures. For this purpose, a restoring spring 47 is furthermore provided which is arranged between the cylinder core 23 and the rotational latch 41. A further spring 49 is arranged in the hoop receiver associated with the long hoop limb 17 and preloads the hoop 15 into its open position so that, when the rotational latch 41 adopts a releasing position, the blocking balls 41 are pressed out of the locking recesses 45 and the hoop 15 is moved into its open position.

As can above all be recognized in FIG. 3, the cylinder core 23 has a row of six equidistant boreholes 51, 51' of the same diameter, the row extending in parallel with the cylinder axis Z and the boreholes extending perpendicular to the cylinder axis Z radially from the outside toward the keyway 31. The securing pin 35 projects partly into the borehole 51' spaced furthest away from the key insertion opening 29, with the groove 37 opening into this borehole 51'. Respective core pins 53 of different lengths are inserted into the other boreholes 51.

In the closed position of the cylinder core 23 shown in the Figures, the boreholes 51, 51' are flush with corresponding throughgoing boreholes 55, 55' of the tumbler housing 27. The securing pin 35 is arranged in the borehole 55' spaced furthest away from the key insertion opening 29. In the other boreholes 55, respective housing pins 57 are inserted toward the cylinder core 23 and respective pin springs 59 are inserted toward to the other side. When the tumbler housing 27 is inserted, as shown, into the further reception opening 25 of the lock body 13, the pin springs 59 are supported directly against the lock body 13 and thus preload the housing pins 57 and the core pins 53 in the direction of the keyway 31.

The core pin 53 of the housing pin 57 and the pin springs 59 of two flush bores 51, 55 each form a pin tumbler. Just that position of the pin tumblers is shown in the Figures which is only adopted against the preload of the pin springs 59 as a rule when a key (not shown) associated with the padlock is inserted into the keyway 31. The associated key then aligns the pin tumblers 53, 57, 59 just so that the separating surface between the core pins 53 and the housing pins 57 coincides with the separating surface between the cylinder core 23 and the tumbler housing 27 so that the cylinder core 23 can be rotated. In all other positions of the pin tumblers 53, 57, 59, the cylinder core 23 is blocked against a rotation by at least one pin tumbler 53, 57, 59.

The shown embodiment of a padlock 11 in accordance with the invention can be produced particularly inexpensively due to the simplified design, in which only a cylinder core 23 without a cylinder housing is provided instead of a complete lock cylinder, without the security of the padlock 11 being disproportionately impaired. The lock body 13 in particular remains undamaged due to the provided tumbler housing 27, in whose boreholes 55 the housing pins 57 are inserted, and also does not have to be post-machined or post-coated after the assembly of the padlock 11. This is not only advantageous with respect to the security, but also makes it possible to color and/or to coat the lock body 13 before the assembly, without the coloring or coating being impaired by the further production. It is possible in this manner also to produce secure padlocks 11 with a colored and/or coated appearance in the starting price segment.

REFERENCE NUMERAL LIST

11 padlock
13 lock body
15 hoop
17 long hoop limb
19 short hoop limb
21 reception borehole
23 cylinder core
25 further reception borehole
27 tumbler housing
29 key insertion opening
31 keyway
33 jacket surface
35 securing pin
37 groove
39 locking device
41 rotational latch
43 blocking ball
45 locking recess
47 restoring spring
49 spring
51' borehole
53 core pin
55' borehole
57 housing pin
59 pin spring
Z cylinder axis

The invention claimed is:

1. A padlock comprising:
a lock body;
a hoop, the hoop being displaceably held at the lock body;
a cylinder core into which at least one core pin is inserted and which is rotatably supported about a cylinder axis in direct contact with a reception opening of the lock body in order selectively to lock or release the hoop at the lock body, wherein the padlock does not comprise a cylinder housing for the cylinder core; and
a tumbler housing that is received as a separate element from and in a fixed position relative to the lock body and into which at least one housing pin is inserted.

2. The padlock in accordance with claim 1, in which the tumbler housing is pressed in the lock body.

3. The padlock in accordance with claim 1, further comprising a securing pin to hold the cylinder core axially fixedly in the lock body.

4. The padlock in accordance with claim 3, in which the securing pin is inserted in a pin passage of the tumbler housing extending in parallel with the at least one housing pin.

5. The padlock in accordance with claim 3, in which the securing pin is inserted in a throughgoing pin passage of the tumbler housing.

6. The padlock in accordance with claim 3, in which the securing pin is arranged behind the at least one housing pin in the key insertion direction.

7. The padlock in accordance with claim 3, in which the cylinder core is axially fixedly held in the lock body only by the securing pin.

8. The padlock in accordance with claim 3, in which the securing pin engages into a groove of the cylinder core extending in the peripheral direction with respect to the cylinder axis.

9. The padlock in accordance with claim 8, in which the capability of being rotated of the cylinder core is restricted to an angular range of less than 180°, in that the groove only extends over a corresponding angular range of the periphery of the cylinder core.

10. The padlock in accordance with claim 9, in which the capability of being rotated of the cylinder core is restricted to an angular range of less than 120°.

11. The padlock in accordance with claim 9, in which the capability of being rotated of the cylinder core is restricted to an angular range approximately 110°.

12. The padlock in accordance with claim 8, in which the groove is arranged behind the at least one core pin in the key insertion direction.

13. The padlock in accordance with claim 1, in which the reception opening is configured as a reception borehole and the lock body has a further reception opening for receiving the tumbler housing.

14. The padlock in accordance with claim 13, in which the further reception opening is a further reception borehole.

15. The padlock in accordance with claim 13, in which the two reception boreholes are arranged next to one another and mutually overlapping.

16. The padlock in accordance with claim 1, in which the tumbler housing is substantially cylindrical and is aligned in parallel with the cylinder core.

17. The padlock in accordance with claim 16, in which the tumbler housing has a cut-out arcuate in cross-section which extends in the axial direction and which the cylinder core contacts.

18. The padlock in accordance with claim 1, further comprising a locking device for the selective locking and release of the hoop, the locking device comprising a rotational latch drive-effectively coupled to the cylinder core and two blocking balls which can be pressed into a respective locking recess of the hoop limbs of the hoop by means of the rotational latch.

19. The padlock in accordance with claim 1, wherein the lock body is free of pin tumbler passages.

20. A padlock comprising:

a lock body;

a hoop, the hoop being displaceably held at the lock body;

a cylinder core into which at least one core pin is inserted and which is rotatably supported about a cylinder axis in direct contact with a reception opening of the lock body in order selectively to lock or release the hoop at the lock body; and a tumbler housing that is received as a separate element from and in a fixed position relative to the lock body and into which at least one housing pin is inserted, the tumbler housing surrounding only a portion of a full periphery of the cylinder core.

* * * * *